US006640507B1

(12) United States Patent
Leconte

(10) Patent No.: US 6,640,507 B1
(45) Date of Patent: Nov. 4, 2003

(54) ACOUSTIC BUILDING STRUCTURE

(75) Inventor: Alain Leconte, Houilles (FR)

(73) Assignee: Saint-Gobain Isover, Courbevoie (FR)

( * ) Notice: Subject to any disclaimer, the term of this patent is extended or adjusted under 35 U.S.C. 154(b) by 0 days.

(21) Appl. No.: 10/088,906

(22) PCT Filed: Aug. 24, 2000

(86) PCT No.: PCT/FR00/02363

§ 371 (c)(1),
(2), (4) Date: Mar. 25, 2002

(87) PCT Pub. No.: WO01/21904

PCT Pub. Date: Mar. 29, 2001

(30) Foreign Application Priority Data

Sep. 23, 1999 (FR) ..... 99 11878

(51) Int. Cl.[7] ..... E04B 1/82
(52) U.S. Cl. ..... 52/145; 52/144
(58) Field of Search ..... 52/144, 145, 404.4, 52/406.3, 309.9, 404.1; 181/284, 290, 291, 292

(56) References Cited

U.S. PATENT DOCUMENTS 2,077,713 A * 4/1937 Ross et al. ..... 52/145
2,966,954 A * 1/1961 Sabine ..... 181/289
3,783,569 A * 1/1974 Roussin ..... 52/480
4,016,689 A * 4/1977 Wendt ..... 52/145
4,244,151 A * 1/1981 Seem ..... 52/60
4,769,963 A * 9/1988 Meyerson ..... 52/309.9
6,122,867 A * 9/2000 Leconte ..... 52/144
6,405,509 B1 * 6/2002 Razl ..... 52/800.12

FOREIGN PATENT DOCUMENTS

| | | | |
|---|---|---|---|
| DE | 40 33 640 | | 4/1992 |
| EP | 0327261 | * | 8/1989 |
| FR | 2 390 558 | | 12/1978 |
| GB | 2214949 | * | 9/1989 |

* cited by examiner

*Primary Examiner*—Anita King
*Assistant Examiner*—Tan Le
(74) *Attorney, Agent, or Firm*—Oblon, Spivak, McClelland, Maier & Neustadt, P.C.

(57) ABSTRACT

An acoustic building structure configured to be fixed to a framework of a building and including at least one first acoustic assembly that includes a panel of mineral wool and a bearer of the panel of mineral wool. The bearer includes a pair of one lower and one upper section pieces spaced apart by a spacing p and each of which includes a respective web each facing the other, and a respective flange bent at right angles to the associated web. The flanges are in one and the same plane and face towards each other. The panel of mineral wool is housed between the webs of the section pieces, and the acoustic assembly includes a rigid panel fixed against the outer faces of the flanges of the section pieces.

12 Claims, 3 Drawing Sheets

ACOUSTIC BUILDING STRUCTURE

The invention relates to an acoustic building structure which is intended to be fixed to the framework of the building and which comprises at least one acoustic assembly comprising a panel of mineral wool and a bearer of the said panel of mineral wool.

Acoustic insulation of a building is commonly obtained using structures of the mass-spring-mass type, an example of which is given in document EP 0921242. Such a structure is made up of two masses each of which consists of a rigid element and which are separated by a panel of mineral wool, such as glass wool, associated with an air gap to form the spring. The two rigid elements are placed one on each side of the framework of the building and fixed mechanically to this very framework or to metal rails added to the framework. These elements consist of sheet metal trays of U-shaped cross section which are lined, inside the U, with a panel of mineral wool, such as rock wool, to improve the mass effect.

The structure described in that document advantageously allows the rigid elements to be fixed directly to the framework of the building or to metal rails associated with the framework without the need for intermediate fixing means. However, the structure, because of the sheet metal nature and tray-shape of the rigid elements, also reaches a cost that it would be desirable to reduce.

Moreover, apart from being related to the nature of the walls, the performance of the acoustic insulation of the building is related to the thickness and to the nature of the spring and of the damper, and to the mass per unit area of the structure which is given by the amount of mineral wool inserted into the bearer and by the sheet metal nature of the bearer. Nonetheless, the mass per unit area is sometimes insufficient and it is therefore necessary, in order to improve the acoustic performance, to add an additional filler into the bottom of the tray, for example a sheet of plasterboard, thus further increasing the cost price of the structure.

The object of the invention is therefore to provide an acoustic structure, particularly one which is of the mass-spring-mass type, which while retaining the advantages of high-performance acoustic insulation and simplicity in the way in which it is fixed to the framework of the building, has a lower overall cost.

According to the invention, the acoustic structure is characterized in that the bearer consists of a pair of one lower and one upper section pieces spaced apart by a spacing p and each of which comprises a respective web, each facing the other, and a respective flange bent at right angles to the associated web, the flanges being in one and the same plane and facing towards each other, and the panel of mineral wool being housed between the webs of the section pieces, and the acoustic assembly includes a rigid panel fixed against the outer faces of the flanges of the section pieces.

This structure has the advantage that the acoustic insulation can directly obtain sufficient mass per unit area without the need to add other thicknesses of surfacing elements as is generally the case with the sheet metal trays of the prior art, which have additional plasterboard sheets placed in the bottom of them.

According to a first embodiment of the section pieces, the upper section piece comprises, on the other side of the web, parallel to and in the opposite direction to the flange, a second flange intended for attaching the acoustic assembly against the framework of the building.

Advantageously, the lower section piece and the upper section piece in this embodiment have complementary shapes so that the upper section piece of the said assembly collaborates with the lower section piece of a second acoustic assembly intended to be assembled with the said first acoustic assembly.

According to a second embodiment of the section pieces, the lower section piece and upper section piece are identical and each has, parallel to the flange, an additional flange so that it has a U-shaped section such that the openings of the U face one another and between which the panel of mineral wool is trapped, the acoustic assembly being fixed to the framework of the building using at least two fixing pieces between which the section pieces are intended to be held, and at least one of which is intended to be fixed to the framework.

Other features and advantages of the invention will now be described in the description which follows, with reference to the drawings in which.

Figure 2:
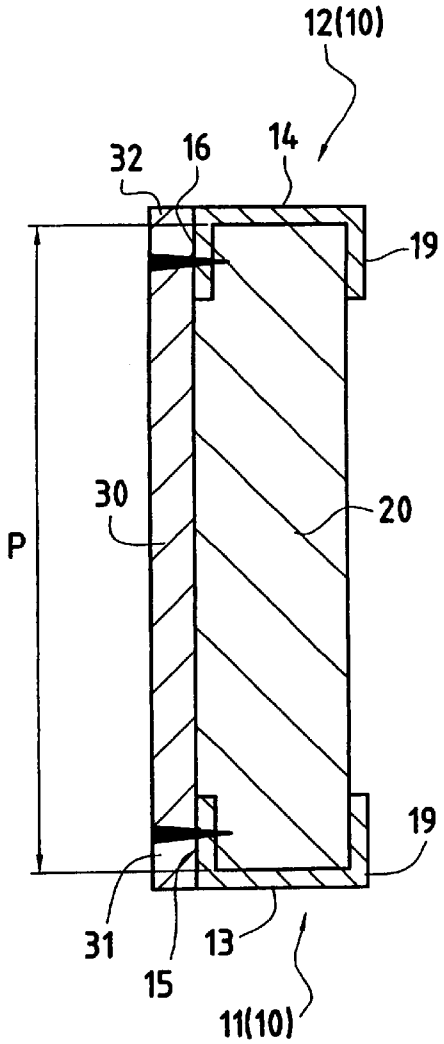
FIG. 2 is a view in section of an acoustic assembly according to a second embodiment of the invention.
Figure 1:
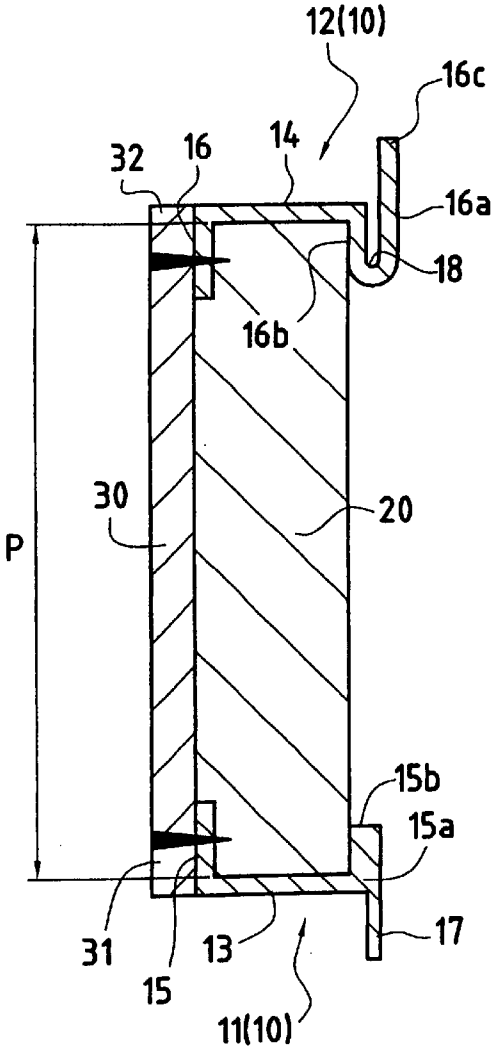
FIG. 1 is a view in section of an acoustic assembly according to a first embodiment of the invention.

The acoustic assembly 1 depicted in FIG. 1 according to a first embodiment and the one depicted in FIG. 2 according to a second embodiment are intended to be applied to and to be mounted against the vertical walls of the building, but could equally well be associated with floors or ceilings, with a view to providing acoustic insulation.

Figure 3:
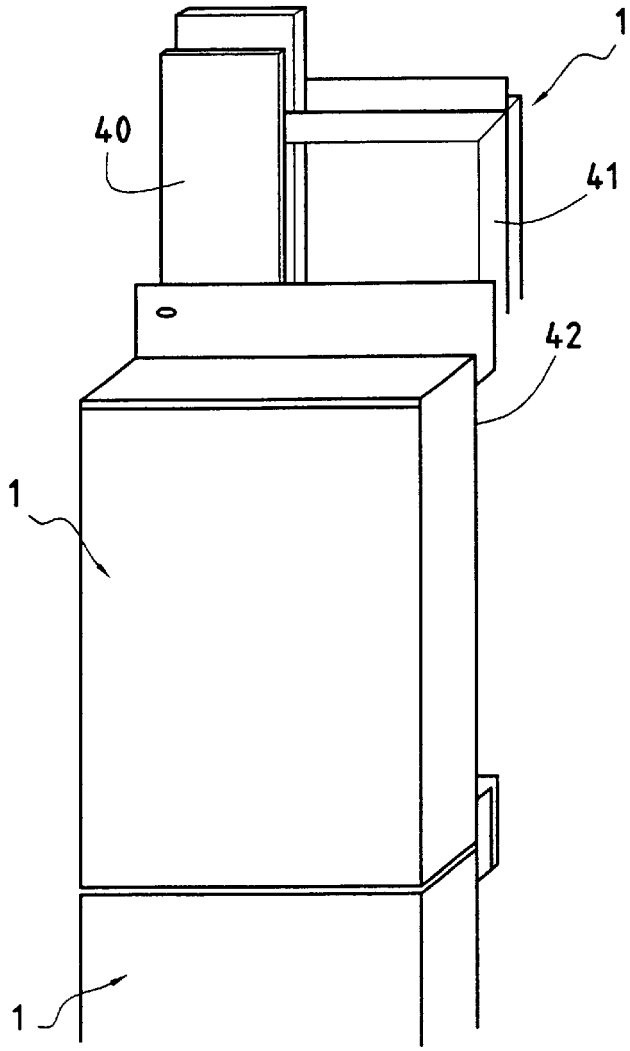
FIG. 3 is a profile view of an acoustic structure of the mass-spring-mess type associated with a building and comprising acoustic assemblies according to the first embodiment of the invention.

These assemblies 1 are especially used in an acoustic structure of the mass-spring-mass type like the one illustrated in FIG. 3. This structure comprises, on each side of the framework 40 of the building, which framework is formed by metal posts or vertical metal rails connected to posts, acoustic assemblies 1 mounted one above the next and constituting, for each face of the structure, each of the masses of the said structure, the masses being separated by the spring which consists of a panel of mineral wool 41, such as glass wool, and by an air gap Each acoustic assembly 1 comprises a metal bearer 10, a panel of mineral wool 20 and a rigid panel 30 contributing to the mass of the assembly and preferably formed from a sheet of plasterboard.

The acoustic assemblies are generally delivered to the site pre-assembled so that the only operations to be performed are simply those of mounting them and fixing them to the framework of the building. The dimensions of an assembly are 400 mm tall by 3.25 to 8 m long, the length being tailored to the distance between two fixing posts of the framework. The width of an assembly is dictated by the width of the bearer 10 and of the sheet of plasterboard 30, the width of the section pieces being tailored to accommodate panels of mineral wool 70 mm thick, and the sheet of plasterboard being 12.5 or 15, or alternatively 18 mm thick, so as to give the acoustic assembly sufficient mass per unit area for the overall acoustic insulation of the structure to exceed 50 db (A) in accordance with current standards.

The bearer 10 of an acoustic assembly 1 consists in a pair of one lower 11 and one upper 12 section pieces located in one and the same plane and separated by a spacing p, and between which the panel of mineral wool 20 is placed. The lower section piece 11 and upper section piece 12 respectively comprise a web 13 and a web 14 each facing the other, and a flange 15 and a flange 16 which are perpendicular to the associated web and which face towards each other.

The invention draws a distinction between two embodiments of the acoustic assembly 1 depending on the shape of the section pieces, incidentally leading to two distinct systems for fixing to the framework of the building.

In a first embodiment (FIG. 1), the lower section piece 11 has, opposite the flange 15, on the other side of the web 13, a flange 15*a* which is parallel to the other flange and in the same direction so as to form a U section inside which the panel of mineral wool 20 can be trapped. As a continuation of the flange 15*a* away from its free end 15*b*, the section piece 11 has a longitudinal assembly strip 17 intended, as will be seen later, to collaborate with another acoustic assembly 1.

The upper section piece 12 in the first embodiment comprises, on the other side of the web 14, another flange 16*a* which is parallel to but in the opposite direction to the flange 16. This flange 16*a* is connected to the web 14 by a groove 18, with the concave side facing away from the lower section piece, and the bottom of which is in a plane parallel to and located below the plane containing the web 14. The lateral surface 16*b* which separates the bottom of the groove 18 from the web 14 plays a part in holding in place the panel of mineral wool 20 inserted between the two section pieces.

Figure 6:
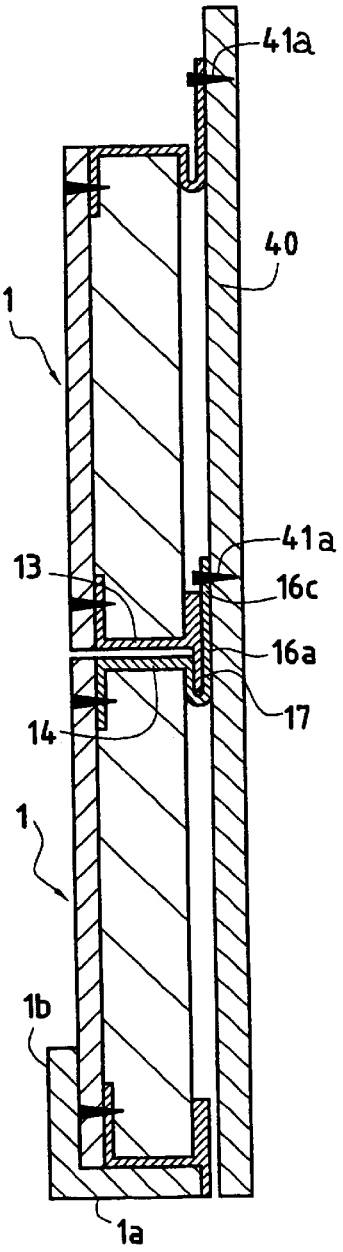
FIG. 6 is a view section of part of an acoustic structure on a plane of the framework of the building, according to the first embodiment.

As illustrated in FIG. 6, the groove 18 of the section piece 12 of a first acoustic assembly is intended to accommodate the assembly strip 17 of a lower section piece 11 belonging to another acoustic assembly intended to be mounted above the first assembly, the web 13 of the lower section piece 11 of the second assembly resting on the web 14 of the upper section piece 12 of the first assembly.

The panel of mineral wool 20 is inserted, trapped and possibly bonded between the two, lower 11 and upper 12, section pieces between the webs 13 and 14, the walls of the flanges 15, 15*a* and 16 and the lateral surface 16*b*.

The rigid panel 30, or the sheet of plasterboard is, for its part, arranged against the outer face of the flanges 15 and 16 of the section pieces and has a height such that its lower edge 31 and upper edge 32 are coplanar with the respective webs 13 and 14 of the section pieces.

The panel 30 is fixed by any known means, such as by bonding, screwing or alternatively by nailing.

According to this first embodiment, the acoustic assembly 1 is fixed to the posts 40 by the upper section piece 12, near the free end 16*c* of the flange 16*a*, by any known fixing means such as self-tapping screws.

The flange 16*a* of the upper section piece is greater in height than the flange 15*a* of a lower section piece so that the fixing means arranged towards the upper end 16*c* are high enough up not to impede, when fitting a second acoustic assembly on a first assembly, the pressing of the flange 15*a* of the lower section piece of the second assembly against the flange 16*a* of the upper section piece of the first assembly while the assembly strip 17 is fitted into the groove 18.

In She second embodiment of the invention (FIG. 2), the issue is one of using, as bearers 10, a lower section piece 11 and an upper section piece 12 which are identical and commercially available and the cross section of which is in the shape of a U, the section pieces having, parallel to the flange 15 and, respectively, to the flange 16, on the other side of the web, flanges 19, the openings of the U facing one another to allow the panel 20 to be housed between the two section pieces.

The rigid panel 30 consisting of a sheet of plasterboard, is fixed against the outer faces of the flanges 15 and 16 of the lower and upper section pieces respectively, its height being tailored such that its lower edge 31 and upper edge 32 are coplanar with the webs 13 and 14 of the section pieces.

Figure 4:
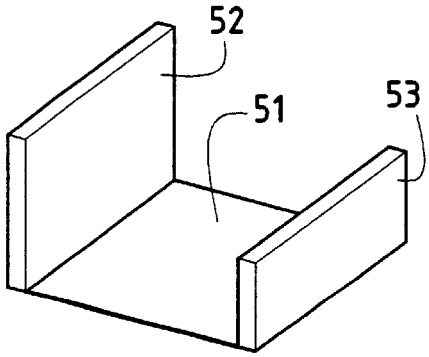
FIGS. 4 and 5 are profile views of pieces used for fixing an acoustic assembly according to the second embodiment.
Figure 5:
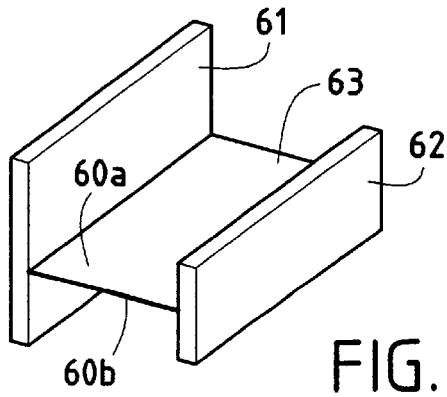

A lower fixing piece 50 (FIG. 4) and an intermediate fixing piece 60 (FIG. 5) have been provided for fixing the acoustic assembly produced according to this second embodiment to the framework of the building. As an alternative, the intermediate piece 60 may be replaced by a piece identical to the lower fixing piece 50.

In the first alternative form, the lower piece 50 is used merely to fix the first acoustic assembly that is to be placed near ground level, the lower piece 50 collaborating with the lower section piece 11. The intermediate piece 60 acts as a means for fixing the acoustic assemblies mounted above the first assembly, the intermediate piece 60 collaborating, on the one hand, with the upper section piece 12 of the first assembly and, on the other hand, with the lower and upper section pieces of the other assemblies placed above it.

The lower fixing piece 50 has a web 51 and, on each side of this web and at right angles to it, a fixing flange 52 and a retaining flange 53, both facing each other. The width of the web 51 is significantly greater than the width of an acoustic assembly.

Figure 7:
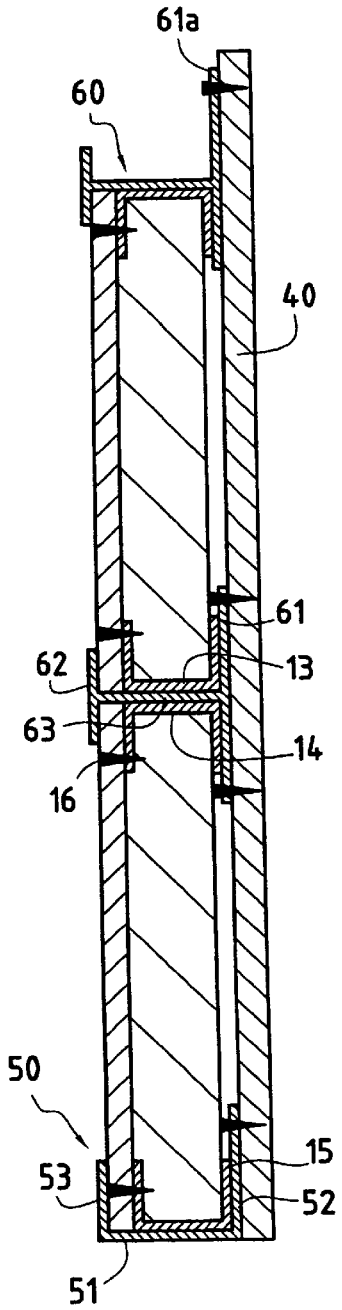
FIGS. 7 and 8 are views in section of part of an acoustic structure on a plane of the framework of the building, according to the second embodiment.

As illustrated by FIG. 7, the piece 50 is intended to be mounted first of all to accommodate the first acoustic assembly. Thus, the fixing flange 52 is intended to be mounted via its outer face against the framework of the building, the inner faces of the fixing flange 52, of the web 51 and of the retaining flange 53 being intended to have resting against them, respectively, the flange 15, the web 13 of the lower section piece 11 and the outer face of the sheet of plasterboard 30. The fixing flange 52 is tall enough for its means of fixing to the framework not to impede the pressing of the flange 15 of the section piece against it.

The intermediate fixing piece 60 has an I-shaped section. It has a fixing surface 61 and a retaining surface 62 parallel to the fixing surface and connected to the latter by a connecting surface 63, the width of which is appreciably greater than that of an acoustic assembly. The connecting surface 63 delimits an upper housing channel 60*a* and a lower housing channel 60*b*.

As illustrated in FIG. 7, the fixing surface 61 is intended to be mounted against the framework of the building while the connecting surface 63 is intended to have resting against it the web 14 of the upper section piece of the first acoustic assembly and the web 13 of the lower section piece of a second acoustic assembly intended to be placed above the first assembly, and the retaining surface 62 is intended to hold the two assemblies in position by having the sheets of plasterboard 30 of the said assemblies resting against it.

Figure 8:
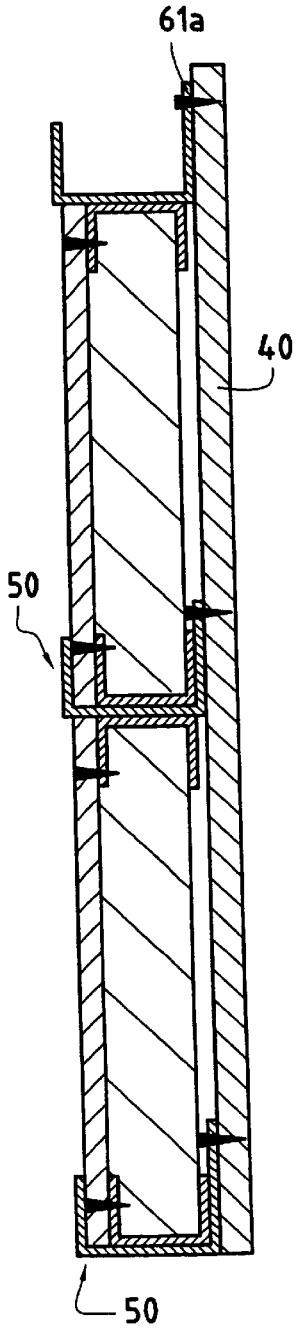

In the second alternative form of the second embodiment which is illustrated in FIG. 8, fixing is by means of identical bracket-shaped pieces 50. A piece is mounted on the upper section piece of an acoustic assembly by fixing, using screws for example, the fixing flange 52 to the framework of the building and the web 51 to the web 14 of the section piece.

We shall now describe the mounting and fixing of one face of an acoustic structure according to the two distinct embodiments of the bearers.

In order to insulate any wall of the building from the floor to the ceiling, a number of acoustic assemblies 1 are fixed, one above the next, starting from ground level, between at least two posts of the framework.

FIG. 6 illustrates two acoustic assemblies according to the first embodiment, once they have been mounted and fixed.

The first acoustic assembly 1 is positioned so that it rests on a wooden sole plate la fixed to the floor and is held pressed against the framework by nailing a wooden lath 1*b* to the sole plate 1*a*. The first assembly is then fixed to the posts of the framework 40 by securing the flange 16*a* of the upper section piece at its upper end 16*c* using screws 41.

A second acoustic assembly 1 is then mounted above the first assembly. First of all, the assembly strip 17 of the lower section piece 11 is engaged in the groove 18 of the upper section piece 12 of the first assembly already fixed, then the said assembly is tilted back towards the framework of the building so as to fit the strip into the groove, so as to seat the web 13 of the lower section piece on the web 14 of the upper section piece of the first assembly, and so as to press the assembly against the posts. Finally, this second assembly is fixed by screwing the flange 16*a* of the upper section piece to the posts.

FIG. 7 illustrates two acoustic assemblies once they have been mounted and fixed according to the second embodiment and according to the first alternative form of this embodiment.

Two pieces 50 are first of all fixed by their respective flange 52 to two aligned posts of the framework 40 of the building, the pieces resting on the ground via the outer face of their web 51. The acoustic assembly 1 is then wedged inside the fixing pieces 50. The assembly is held in a vertical position to prevent any tipping by the flanges 53 of the pieces 50. The assembly is fixed to the framework using two intermediate fixing pieces 60 which are mounted on the upper edge face of the assembly in the region of the two posts. The lower part of the fixing surface 61 is inserted between a post and the flange 16 of the upper section piece, the retaining surface 62 has its lower part pressed against the sheet of plasterboard 30 of the first assembly and the connecting surface 63 rests on the web 14 of the upper section piece, the lower channel 60*b* of the piece thus capping part of the upper edge face of the acoustic assembly. The upper part 61*a* of the fixing surface 61 is then fixed by screwing to the associated post to fix the piece and hold the said assembly firmly in place.

The upper channel 60*a* of the fixing pieces will act as a housing to accommodate a second assembly, the web 13 of the lower section piece 11 of this assembly resting on the connecting surfaces 63 of the pieces. In the same way as for the fixing of the first assembly, two pieces 60 are attached to the top of the second assembly, the upper edge face of the assembly being housed in the lower channel 60*b* of the new pieces, then these pieces are fixed by their surface 61 to the posts so as to fix the second acoustic assembly.

Let us note that the outer faces of the retaining surfaces 62 of the pieces 60 and of the flanges 53 of the pieces 50 may act as supports for attaching a decorative facing intended to cover the sheets of plasterboard 30.

What is claimed is:

1. An acoustic building structure configured to be attached to a framework of a building, comprising:

a first acoustic assembly comprising:

a panel of mineral wool;

a bearer of the panel of mineral wool comprising lower and upper section pieces spaced apart by a spacing, the lower section piece comprising a lower web and a lower flange extending at about a right angle from the lower web, and the upper section piece comprising an upper web and an upper flange extending at about a right angle from the upper web, the lower and upper webs facing one another, the lower and upper flanges extending in a same plane and facing a same direction, and the panel of mineral wool housed between the lower and upper webs; and a rigid panel attached to outer faces of the lower and upper flanges, wherein the upper section piece comprises an attaching flange extending parallel with and in a direction opposite to the upper flange, the attaching flange configured to attach the first acoustic assembly to the framework of the building.

2. The acoustic structure according to claim 1, the upper section piece is adapted to receive a portion of a lower section piece of a second acoustic assembly.

3. The acoustic structure according to claim 2, wherein the lower section piece comprises an assembly strip extending parallel with and in a direction opposite to the lower flange, and the upper section piece comprises a groove connecting the upper web and the upper flange, the assembly strip is configured to be received in the groove.

4. The acoustic structure according to claim 3, wherein the lower section piece comprises a retaining flange, and the upper section piece comprises a lateral surface that separates a bottom of the groove from the upper web, the panel of mineral wool is housed among the lower flange and the retaining flange of the lower section piece and the upper flange and the lateral surface of the upper section piece.

5. An acoustic building structure configured to be attached to a framework of a building, comprising:

a first acoustic assembly comprising:

a panel of mineral wool;

a bearer of the panel of mineral wool comprising lower and upper section pieces spaced apart by a spacing, the lower section piece having a lower U-shaped section including a lower web and lower first and second flanges that are parallel with one another and extend at right angles to the lower web, the upper section piece having an upper U-shaped section including an upper web and upper first and second flanges, openings of the lower and upper U-shaped sections facing one another to house the panel of mineral wool between the lower and upper section pieces;

a rigid panel attached to outer faces of the lower and upper first flanges; and a first fixing piece adapted to be disposed between the lower section piece and an upper section piece of a second acoustic assembly and to be attached to the framework of the building, the first fixing piece adapted to surround at least a portion of the lower second flange.

6. The acoustic structure according to claim 5, wherein the first fixing piece comprises a fixing web and a fixing flange and a retaining flange facing one another and extending from the web, the fixing flange configured to be attached to the framework of the building and to receive the lower flange of the lower section piece.

7. The acoustic structure according to claim 5, wherein the first fixing piece has an I-shaped section and comprises a fixing surface, a retaining surface parallel to the fixing surface, and a connecting surface connecting the fixing surface to the retaining surface to form an upper channel and a lower channel, the fixing surface configured to be attached to the framework of the building at an upper end, and the lower channel receives a portion of the first acoustic assembly and the upper channel is configured to receive a portion of a second acoustic assembly.

8. The acoustic structure according to claim 6, wherein the rigid panel has a height equivalent to the spacing of the first and second section pieces.

9. The acoustic structure according to claim 1, wherein the rigid panel comprises a sheet of plasterboard.

10. Acoustic building structure configured to be fixed to a framework of a building and comprising:

at least one first acoustic assembly comprising:

a panel of mineral wool;

a bearer of the panel of mineral wool, which includes a pair of one lower and one upper section pieces spaced apart by a spacing, which are identical, and each of which has a U-shaped section with a web and first and second flanges, which first and second flanges are parallel and extend at right angles to the web, and such that openings of the U-shaped sections face each other to trap the panel of mineral wool therebetween; and a rigid panel fixed against outer faces of the first and second flanges of the section pieces, wherein the acoustic assembly is adapted to be fixed to the framework of the building by at least first and second fixing pieces between which the lower and upper section pieces are configured to be held, and at least one of the lower and upper sections is configured to be fixed to the framework, and wherein the first fixing piece comprises a web and, on each side of the web, facing each other, a fixing flange and a retaining flange, the fixing flange configured to be fixed to the framework of the building and to have, resting against it, the lower flange of the lower section piece, whereas the web of the piece accommodates the web of the lower section piece and the retaining flange holds the acoustic assembly in position in the piece.

11. Acoustic building structure configured to be fixed to a framework of a building and comprising:

at least one first acoustic assembly comprising:

a panel of mineral wool;

a bearer of the panel of mineral wool, which includes a pair of one lower and one upper section pieces spaced apart by a spacing, which are identical, and each of which has a U-shaped section with a web and first and second flanges, which first and second flanges are parallel and extend at right angles to the web, and such that openings of the U-shaped sections face each other to trap the panel of mineral wool therebetween; and a rigid panel fixed against outer faces of the first flanges of the section pieces, wherein the acoustic assembly is adapted to be fixed to the framework of the building by at least first and second fixing pieces between which the lower and upper section pieces are configured to be held, and at least one of the lower and upper sections is configured to be fixed to the framework, and wherein the second fixing piece has an I-shaped section and comprises a fixing surface, a retaining surface parallel to the fixing surface, and a connecting surface connecting the fixing surface to the retaining surface and delimiting an upper channel and a lower channel, the fixing surface configured to be fixed against the framework of the building at its upper end, whereas the lower channel houses part of the upper edge face of the acoustic assembly and the upper channel is configured to house part of the lower edge face of a second acoustic assembly that is configured to be fitted above the first assembly.

12. Acoustic structure according to claim 10, wherein the rigid panel has a height equivalent to the spacing of the section pieces.

* * * * *